US010428827B2

(12) United States Patent
Yamada et al.

(10) Patent No.: US 10,428,827 B2
(45) Date of Patent: Oct. 1, 2019

(54) CENTRIFUGAL FAN WITH A CASING INCLUDING STRUCTURE FOR ENGAGING WITH AN OBJECT TO WHICH THE CENTRIFUGAL FAN IS INSTALLED

(71) Applicant: MINEBEA MITSUMI INC., Kitasaku-gun, Nagano (JP)

(72) Inventors: Takuji Yamada, Yaizu (JP); Masaaki Matsubara, Fukuroi (JP); Seiya Fujimoto, Fukuroi (JP); Kiyohisa Nara, Fukuroi (JP)

(73) Assignee: MINEBEA MITSUMI INC., Nagano (JP)

( * ) Notice: Subject to any disclaimer, the term of this patent is extended or adjusted under 35 U.S.C. 154(b) by 111 days.

(21) Appl. No.: 15/298,778

(22) Filed: Oct. 20, 2016

(65) Prior Publication Data

US 2017/0114791 A1 Apr. 27, 2017

(30) Foreign Application Priority Data

Oct. 23, 2015 (JP) ..... 2015-209004
Feb. 29, 2016 (JP) ..... 2016-037313

(51) Int. Cl.
*F04D 29/16* (2006.01)
*F04D 29/28* (2006.01)
(Continued)

(52) U.S. Cl.
CPC ..... *F04D 29/162* (2013.01); *F04D 25/06* (2013.01); *F04D 25/0693* (2013.01);
(Continued)

(58) Field of Classification Search
CPC .... F04D 29/667; F04D 29/281; F04D 29/162; F04D 29/4226; F04D 25/06; F04D 13/06;
(Continued)

(56) References Cited

U.S. PATENT DOCUMENTS

2012/0121407 A1* 5/2012 Yamashita ..... F04D 17/162 415/213.1
2016/0290358 A1* 10/2016 Hayamitsu ..... F04D 17/16

FOREIGN PATENT DOCUMENTS

JP 56-081297 A 7/1981
JP 01-103798 U 7/1989
(Continued)

OTHER PUBLICATIONS

Notification of Reasons for Refusal dated Feb. 23, 2018 for corresponding Japanese Application No. 20106-037313 and English translation.

(Continued)

*Primary Examiner* — Essama Omgba
*Assistant Examiner* — Stephen A Mick
(74) *Attorney, Agent, or Firm* — Pearne & Gordon LLP

(57) ABSTRACT

The present invention provides a centrifugal fan that can be easily positioned when it is installed in a device or apparatus, which can further improve positioning accuracy, and which can decrease noise, even if it is made thin. In the centrifugal fan in which an impeller is received inside a casing and air drawn in from a suction port formed on the casing by rotating the impeller is discharged from the casing to the outside of a blowing port, a circular protruded portion is formed on a peripheral edge of the suction port, and protrudes upwardly in a shaft direction from an upper surface of the casing.

8 Claims, 7 Drawing Sheets

(51) Int. Cl.
*F04D 29/42* (2006.01)
*F04D 25/06* (2006.01)
*F04D 25/08* (2006.01)

(52) U.S. Cl.
CPC ..... *F04D 25/08* (2013.01); *F04D 29/281* (2013.01); *F04D 29/4226* (2013.01)

(58) Field of Classification Search
CPC ..... F04D 13/0673; F04D 25/0613; F04D 25/064; F04D 25/08; F04D 25/0693
USPC ..... 417/352–354, 423.14
See application file for complete search history.

(56) References Cited

FOREIGN PATENT DOCUMENTS

| | | | |
|---|---|---|---|
| JP | 02-071000 | A | 3/1990 |
| JP | 63-215900 | A | 9/1998 |
| JP | 11-090149 | A | 4/1999 |
| JP | 2012-140922 | A | 7/2012 |
| JP | 2012-207600 | A | 10/2012 |

OTHER PUBLICATIONS

Japanese Office Action dated Oct. 27, 2017 for corresponding Japanese Application No. 2015-209004 and English translation.

* cited by examiner

CENTRIFUGAL FAN WITH A CASING INCLUDING STRUCTURE FOR ENGAGING WITH AN OBJECT TO WHICH THE CENTRIFUGAL FAN IS INSTALLED

TECHNICAL FIELD

The present invention relates to a centrifugal fan that can be easily positioned when it is installed in a housing of another device or apparatus.

BACKGROUND ART

A centrifugal fan is known as an air blower and is widely used for cooling, ventilating, and air-conditioning in household electrical appliances, office equipment and industrial equipment, or air-conditioning and forcing air in an automobile, etc. As a conventional centrifugal fan, a centrifugal fan in which a casing is formed by an upper casing and a lower casing, and an impeller is housed between the upper casing and the lower casing, and air drawn in from a suction port by rotating the impeller is discharged outwardly from a blowing port formed on a side surface between the upper casing and the lower casing, is known (see Japanese Unexamined Patent Application Publication No. 2012-207600).

FIG. 7 shows a centrifugal fan 100 described in Japanese Unexamined Patent Application Publication No. 2012-207600. In the centrifugal fan 100, a squared shaped casing 120 is formed by an upper casing 121 and a lower casing 122, and an impeller 130 is housed between the upper casing 121 and the lower casing 122. The impeller 130 has a circular shroud 131. The air drawn in from a suction port 110 by high-speed rotation of the impeller 130 is passed through blades 135, it is blown outwardly from an out periphery of the impeller 130, and it is discharged outwardly from a blowing port 111 formed on a side surface between the upper casing 121 and the lower casing 122.

In Japanese Unexamined Patent Application Publication No. 2012-207600, a specific structure in the case in which the centrifugal fan is installed in a housing of another device or apparatus is not described. The centrifugal fan described in this document is fixed to a housing of a device or apparatus generally by forming flanges which extend outwardly in a radial direction at multiple positions, and by passing bolts, screws, etc., through pass-through holes formed at the flanges.

However, in the case in which high accuracy of positioning of the centrifugal fan is desired, the centrifugal fan cannot be easily positioned and high accuracy of the positioning cannot be easily performed, even if it is fixed to the housing of the device or the apparatus by using the bolts, screws, etc., as described above. Furthermore, in the centrifugal fan having a conventional structure described in Japanese Unexamined Patent Application Publication No. 2012-207600, it is necessary that the centrifugal fan be made thin by decreasing total height thereof, when a mounting space for the centrifugal fan is small. In this case, since it is also necessary to use a thin type impeller, a cross-sectional area of a passage at an air suction side of the impeller is decreased, and ventilation resistance is increased, and as a result, noise is increased.

In view of such circumstances, an object of the present invention is to provide a centrifugal fan that can be easily positioned when installed in a device or apparatus, which can further improve positioning accuracy, and which can decrease noise, even if it is made thin.

DISCLOSURE OF THE INVENTION

A first aspect of the present invention is characterized in that a centrifugal fan, in which an impeller is received inside a casing, air drawn in from a suction port formed on the casing by rotating the impeller, is discharged from the casing to the outside of a blowing port, and a circular protruded portion is formed on a peripheral edge of the suction port, and protrudes upwardly in a shaft direction from an upper surface of the casing.

In the first aspect of the present invention, it is preferable that a circular groove be formed on a lower surface of the circular protruded portion of the casing, and the circular protruded portion be formed on a circular shroud that is a part of members for composing the impeller, and be located in the circular groove.

In the first aspect of the present invention, it is preferable that a labyrinth seal structure be formed between the circular groove and the circular protruded portion formed on the circular shroud.

In the first aspect of the present invention, it is preferable that the circular protruded portion formed on the circular shroud be formed at an upper edge in a shaft direction of the circular shroud.

In the first aspect of the present invention, it is preferable that the circular protruded portion formed on the circular shroud be formed on a step of an upper surface or an inclined surface of the circular shroud.

In the first aspect of the present invention, it is preferable that the casing be formed by an upper casing and a lower casing, pillars be intervened between the upper casing and the lower casing, and the blowing port be formed between the pillars and on a side surface of the casing.

A second aspect of the present invention is characterized in that a centrifugal fan, in which an impeller is received inside a casing, air drawn in from a suction port formed on the casing by rotating the impeller, is discharged from the casing to the outside of a blowing port, and multiple gap portions for engaging with an object in which the centrifugal fan is installed is formed on an upper surface of the casing, the multiple gap portions comprise a first gap portion composed by a circular protruded portion which protrudes upwardly in a shaft direction and which is formed on a peripheral edge of the suction port, and a second gap portion formed outside in a radial direction of the circular protruded portion, and the circular protruded portion protrudes upwardly from the second gap portion.

In the second aspect of the present invention, it is preferable that a circular groove be formed on a lower surface of the circular protruded portion, and the circular protruded portion be formed at an upper edge of a circular shroud which is a part of members for composing the impeller, and a top of the circular protruded portion be located in the circular groove.

In the second aspect of the present invention, it is preferable that the top of the circular protruded portion formed at an upper edge of the circular shroud be overlapped with a peripheral side surface of the second gap portion, when it is viewed from a perpendicular direction to a rotating shaft.

In the second aspect of the present invention, it is preferable that a labyrinth seal structure formed between the casing and the impeller be overlapped with a peripheral side surface of the second gap portion, when it is viewed from a perpendicular direction to a rotating shaft.

In the second aspect of the present invention, it is preferable that a first step and a second step be formed on an upper surface of a circular shroud, and the second gap portion of the casing be opposite to the first step.

According to the present invention, a centrifugal fan that can be easily positioned when it is installed in a device or apparatus, that can further improve positioning accuracy, and that can decrease noise, even if it is made thin, can be provided.

PREFERRED EMBODIMENTS OF THE INVENTION

1. First Embodiment (1) Structure of Centrifugal Fan

Figure 1:
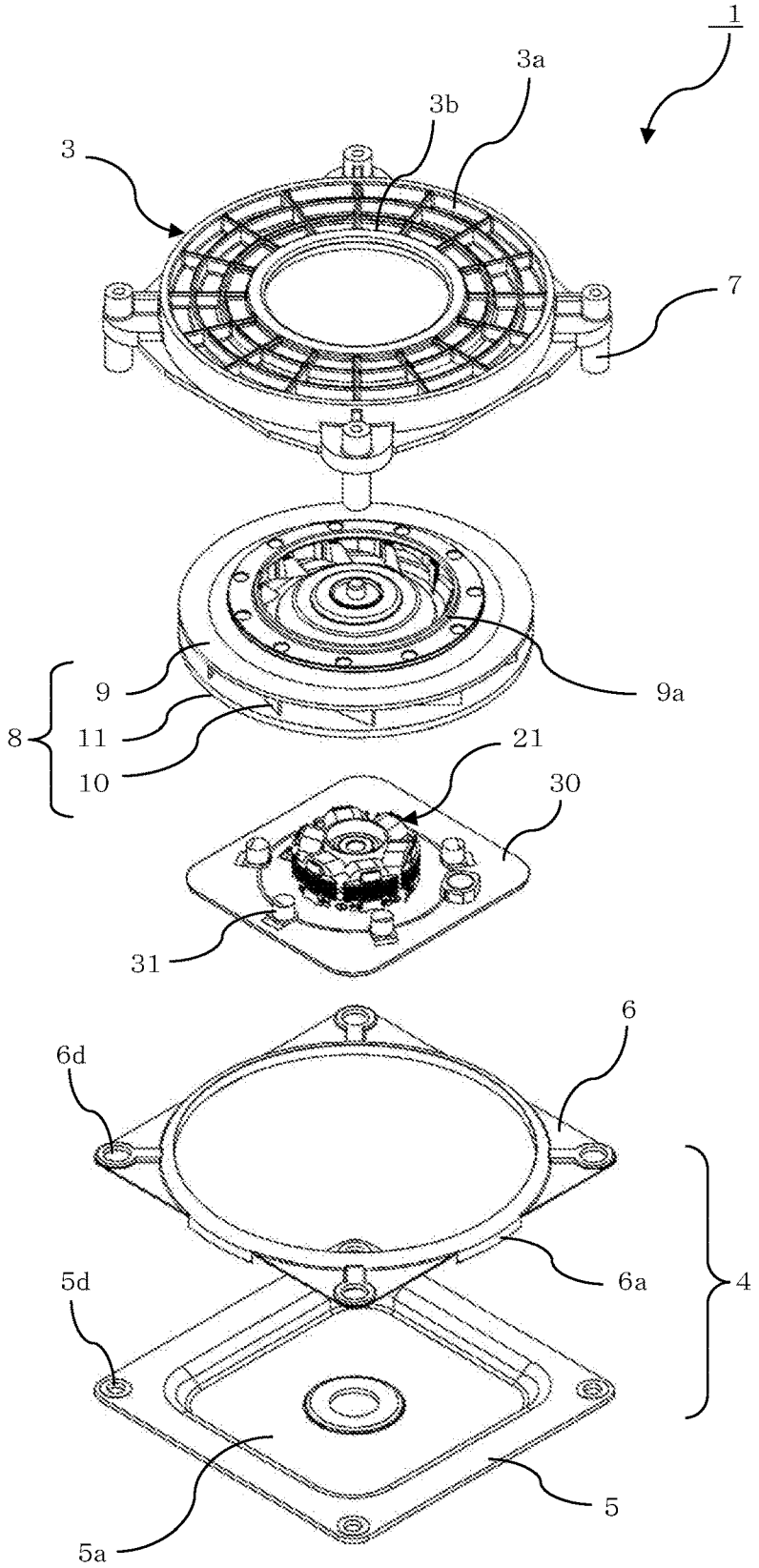
FIG. 1 is an exploded perspective view showing a centrifugal fan of a first embodiment of the present invention.
Figure 2:
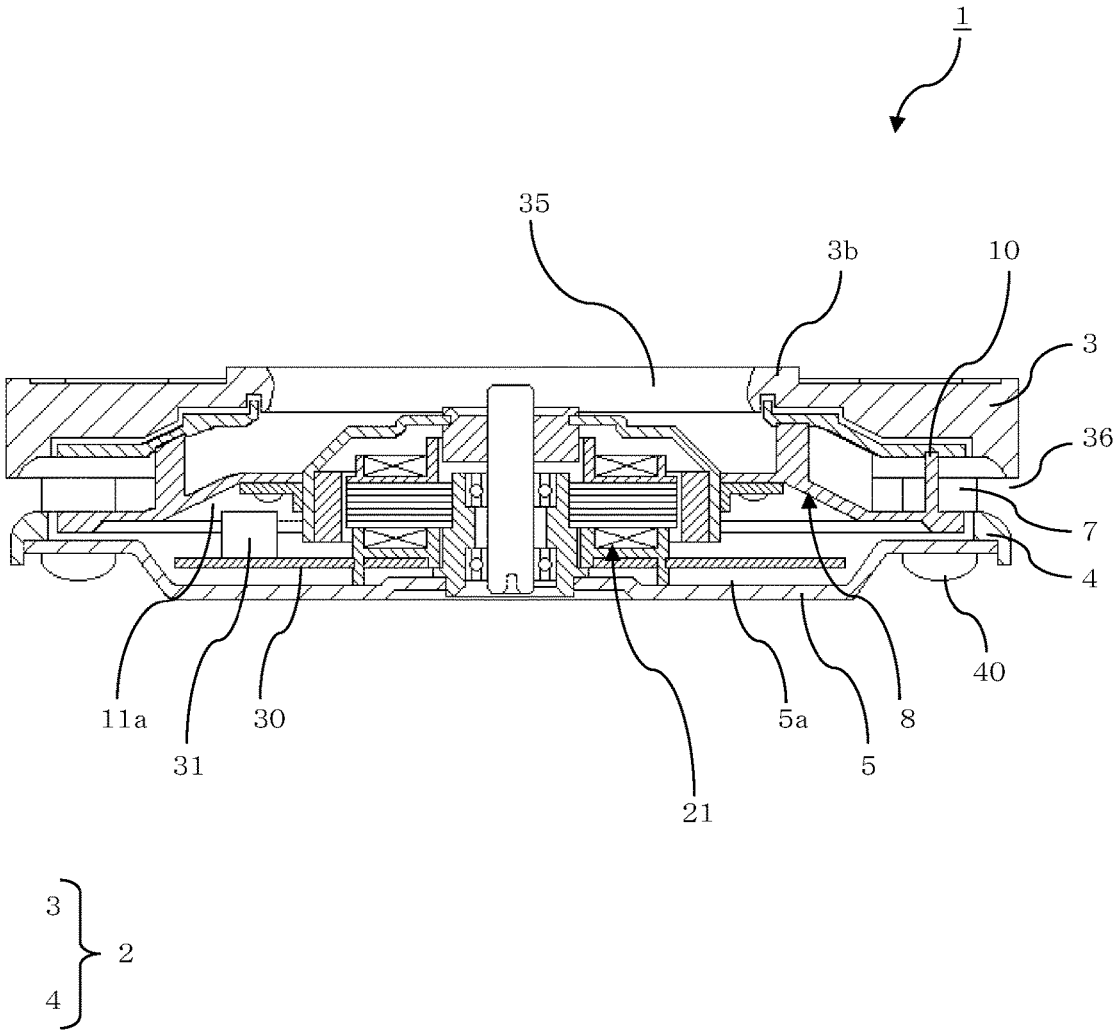
FIG. 2 is a cross-sectional view perspective view showing the centrifugal fan in FIG. 1.
Figure 3:
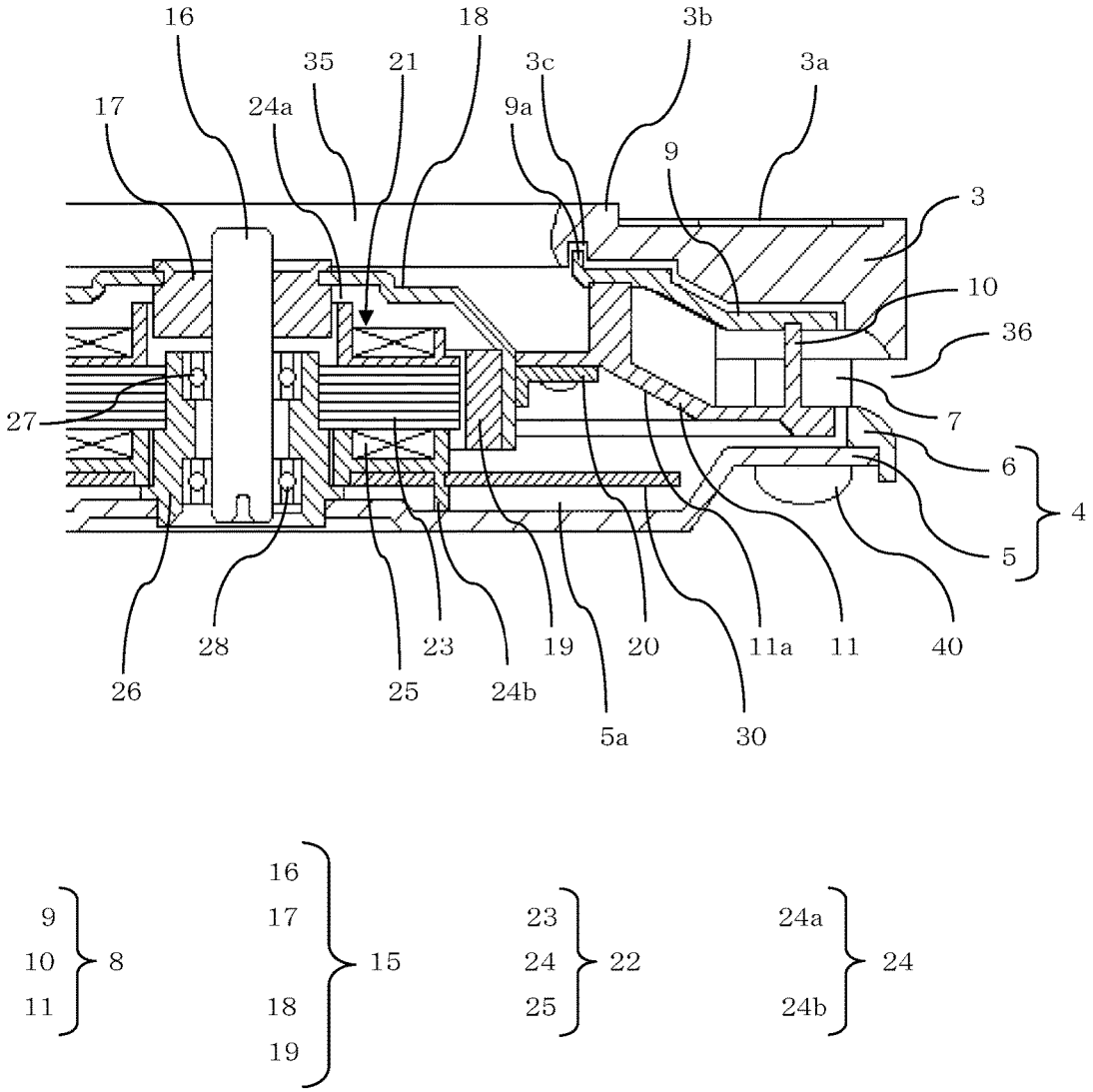
FIG. 3 is a partially enlarged view showing the centrifugal fan in FIG. 2.

FIG. 1 is an exploded perspective view showing a centrifugal fan of a first embodiment of the present invention. FIG. 2 is a cross-sectional perspective view showing the centrifugal fan in FIG. 1. FIG. 3 is a partially enlarged view showing the centrifugal fan in FIG. 2. In FIG. 2, the centrifugal fan 1 of the present embodiment is shown. A basic structure of the centrifugal fan 1 includes a casing 2, which is a similar structure to that described in Japanese Unexamined Patent Application Publication No. 2012-207600. The casing 2 is composed of an upper casing 3 and a lower casing 4, and an impeller 8 is housed between the upper casing 3 and the lower casing 4 (see FIG. 1).

Air drawn in from a suction port 35 by rotating the impeller 8 is passed through blades 10, and is discharged from blowing ports 36 formed on a side surface except for pillars 7 intervened between the upper casing 3 and the lower casing 4 to the outside of the casing 2 (outside in a radial direction). The impeller 8 is driven and rotated by a motor 21 that is an outer rotor type brushless DC motor. The motor 21 is mounted on a bottom surface of a concavity 5*a* formed on a motor base 5.

The motor 21 has a stator 22, as shown in FIG. 3. The stator 22 comprises a stator core 23 in which a desired number of cores in a thin plate shape are laminated, an insulator 24 formed by an upper insulator 24*a* and a lower insulator 24*b* mounted from both sides in a shaft direction of the stator core 23, and a coil 25 wound around teeth of the stator core 23 via the insulator 24.

The core in a thin plate shape that forms the stator core 23 has multiple teeth (six teeth in FIG. 3) that extend to the outside in a radial direction from a circular yoke. A bearing holding portion 26 engages with an opening formed at the center of the stator core 23, and the stator 22 is arranged outside of the bearing holding portion 26. Bearings 27,28 are mounted inside of the bearing holding portion 26, and a shaft 16 is rotatably supported to the bearings 27,28. A circuit board 30 is mounted on the lower insulator 24*b*, and the circuit board 30 is housed in the concavity 5*a*.

A rotor 15 comprises the shaft 16, a boss portion 17 mounted on the shaft 16, a rotor yoke 18 in a cup shape mounted on the boss portion 17, and a circular magnet 19 fixed to the inside of the rotor yoke 18. The rotor yoke 18 is fixed to the boss portion 17 by calking.

The impeller 8 is connected with an outer periphery of the rotor yoke 18 by using a flange 20. The impeller 8 comprises a circular shroud 9, multiple blades 10, and a main plate 11 in a disc shape, as shown in FIG. 1, and the blades 10 and the main plate 11 are formed unitarily of resin. The blade 10 is formed in a shaft direction on the main plate 11, has a shape which is bent and tilted backwardly in a rotating direction, and is a backwardly tilted blade in a rotating direction (a so-called turbo type blade). All of the blades 10 have the same shape. The blades 10 and the circular shroud 9 are joined by ultrasonic welding.

An upper surface of the circular shroud 9 has two steps, and each step is formed to be a flat surface and an inclined surface is formed between the steps, and a circular protruded portion 9*a* is formed at an upper edge in a shaft direction of the circular shroud 9. An electrode of an ultrasonic welding device is easily contacted by this flat surface of the step when the blades 10 and the circular shroud 9 are joined by ultrasonic welding. A top of the circular protruded portion 9*a* formed at an upper edge in a shaft direction of the circular shroud 9 is located in a circular concavity (groove) 3*c* formed at a lower surface of the upper casing 3 and it is covered with the upper casing 3.

The main plate 11 of the impeller 8 has an inclined surface 11*a* between an inner peripheral side and an outer peripheral side. That is, the inner peripheral side of the impeller 8 is located at an upper side in a shaft direction, the outer peripheral side of the impeller 8 is located at a lower side in a shaft direction, and the inclined surface 11*a* is located between the inner peripheral side and the outer peripheral side.

The impeller 8 and the rotor 15 are joined in the following manner. First, the circular flange 20 is welded on an outer peripheral surface of the rotor yoke 18 by, for example, resistance welding. Next, the main plate 11 is fixed to the flange 20. A pin (not shown) is formed in one body on a lower surface at an inner peripheral side of the main plate 11, this pin is engaged with a pass-through hole formed on the flange 20, and the main plate 11 is fixed to the flange 20 by calking, that is, by heating and deforming a tip of the pin. Therefore, the impeller 8 is mounted on the rotor 15.

An opening as the suction port 35 is formed at the center of the upper casing 3, a circular protruded portion 3*b* that protrudes upwardly in a shaft direction is formed on a periphery of the opening, multiple concavities 3*a* (relief portions) are formed at an outer peripheral side of the circular protruded portion 3*b* and at an upper side of the upper casing 3, and multiple ribs are radially formed between the concavities 3*a* (see FIG. 1). The upper casing 3 and the lower casing 4 are joined by intervening pillars 7 between the upper casing 3 and the lower casing 4 and by fastening the pillars 7 using fastening members such as screws. Specifically, the pillars 7 are formed in one body by the upper casing 3 and resin, and lower holes are formed on the pillars 7. Then, the upper casing 3 and the lower casing 4 are joined by passing the pillars 7 through a pass-through hole 6*d* of the lower casing 4 (a base plate 6), and by screwing tapping screws 40 into the lower holes of the pillars 7 through pass-through holes 5*d* (see FIG. 1). Here, a fastening means is not limited to this process, and for example, the casings may be fixed by passing screws (or bolts) through the pass-through holes of the pillars 7 from a side of the lower casing 4, and by fastening nuts from a side of the upper casing 3.

The lower casing 4 is formed by laminating a motor base 5 made of metal (for example, a steel plate) and the base plate 6 made of resin. The motor 21 is mounted on a lower surface of the concavity 5*a* formed on the motor base 5. Side portions 6*a* (see FIG. 1) which extend downwardly are formed at four positions on an outer peripheral edge of the base plate 6, and an outer periphery of four sides of the motor base 5 is contacted with the inside of these side portions 6*a*, so that the motor base 5 and the base plate 6 are positioned.

Electronic components 31 such as a controlling IC or parts for controlling and driving the motor 21, etc., is mounted on the circuit board 30. Here, in order to prevent the impeller 8 from contacting the electronic components 31 mounted on the circuit board 30 in a limited space, the inclined surface 11*a* is formed on the main plate 11, and a part of the electronic components 31 is contained at a position of this inclined surface 11*a*. Therefore, the impeller 8 can be prevented from contacting the electronic components 31, and the centrifugal fan can be made thin in a shaft direction.

(2) Features

An opening as the suction port 35 is formed at the center of the upper casing 3, and the circular protruded portion 3*b* that protrudes upwardly in a shaft direction is formed on a periphery of the opening, and this circular protruded portion 3*b* protrudes upwardly from an upper surface of the upper casing 3. When the centrifugal fan 1 is installed in a housing of another device or apparatus, the centrifugal fan 1 can be easily positioned in mounting on the device or the apparatus and accuracy of the positioning can be improved, by fitting this circular protruded portion 3*b* as a socket-and-spigot structure. In addition, in connection with size of the opening formed on the housing, it is not necessary to consider variation in mounting the centrifugal fan 1.

The circular concavity (groove) 3*c* is formed on a lower surface of the circular protruded portion 3*b* of the upper casing 3, and a top of the circular protruded portion 9*a* formed at an upper edge in a shaft direction of the circular shroud 9 is located in the circular concavity (groove) 3*c* formed on a lower surface of the upper casing 3. In this structure, the circular protruded portion 9*a* is covered with the upper casing 3. Then, a labyrinth seal structure is formed between a side surface of the protruded portion 9*a* of the circular shroud 9 and the upper casing 3. According to this labyrinth structure, a part of the air blown out from an outer periphery of the impeller can be prevented from flowing in an opposite direction to the suction port 35.

In addition, although the labyrinth structure is formed on the lower surface of the circular protruded portion 3*b* of the upper casing 3, the circular protruded portion 3*b* is located in the device or the apparatus since the circular protruded portion 3*b* of the upper casing 3 is used as a socket-and-spigot structure in mounting to the device or the apparatus. Therefore, a height in a shaft direction of the centrifugal fan 1 is substantially a height from the lower surface of the lower casing 4 to the upper surface of the upper casing 3, and an effective height can be decreased.

A width in a radial direction of the circular protruded portion 3*b* is not limited to a specific range, and the width may be a width of a step which is located at a side of the suction port 35 formed on the upper surface of the circular shroud 9 or a width having a position of an inclined surface formed between two steps.

Although the protruded portion 9*a* of the circular shroud 9 is formed at the upper edge in a shaft direction, it is not limited to this structure, and it may be formed on the step which is located at a side of the suction port 35 or it may be formed at the position of the inclined surface formed between two steps.

The circular concavity (groove) 3*c* formed on the lower surface of the protruded portion 3*b* of the upper casing 3 is formed at a position corresponding to the circular protruded portion 9*a* formed on the circular shroud 9, and the top of the circular protruded portion 9*a* is located in the circular concavity (groove) 3*c*.

This circular protruded portion 3*b* may be used as a position for mounting the other members (for example, a cover, etc.), and may be used for positioning, except that the circular protruded portion 3*b* is used as a socket-and-spigot structure.

2. Second Embodiment (1) Structure of Centrifugal Fan

Figure 4:
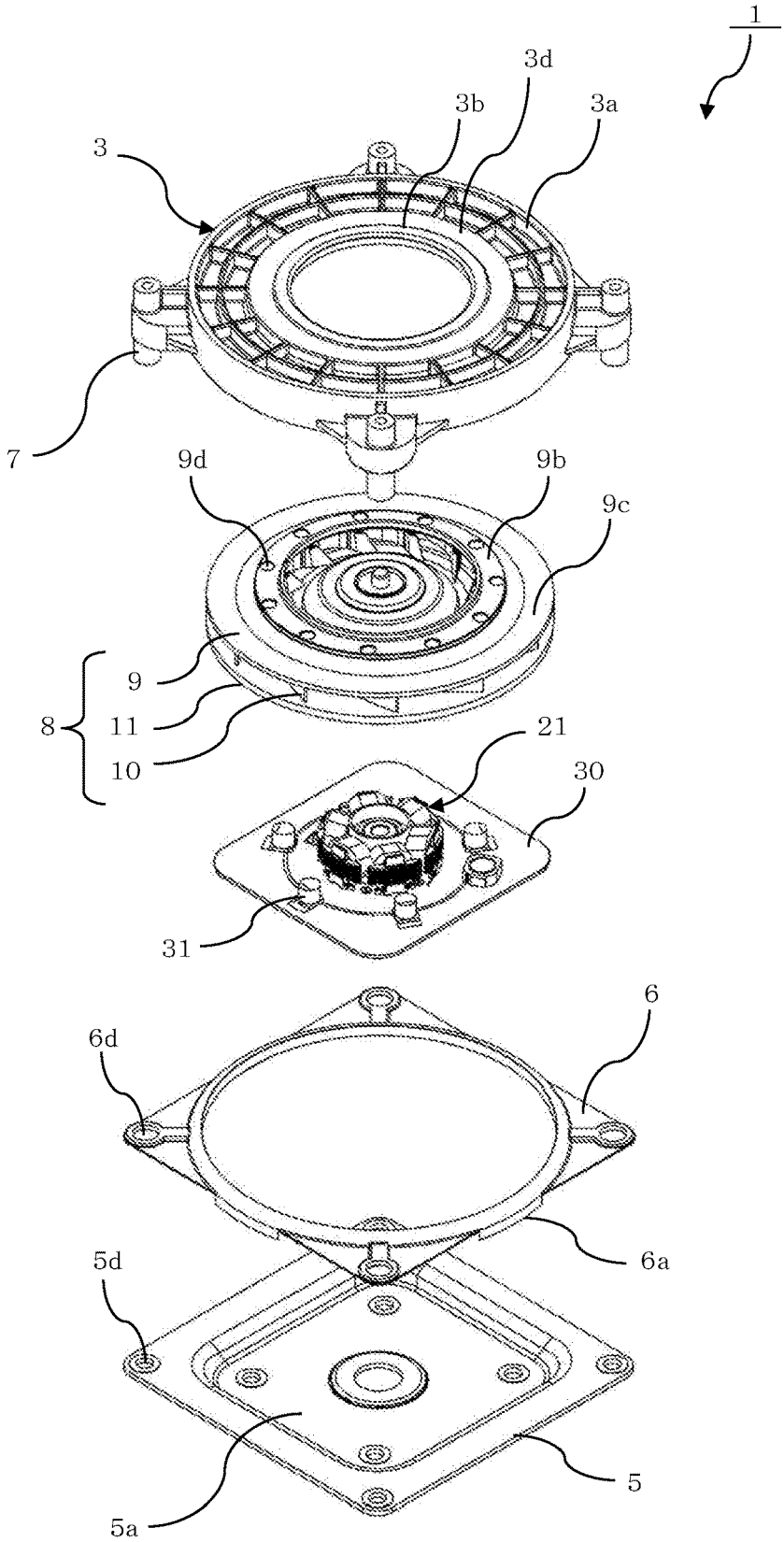
FIG. 4 is an exploded perspective view showing a centrifugal fan of a second embodiment of the present invention.
Figure 5:
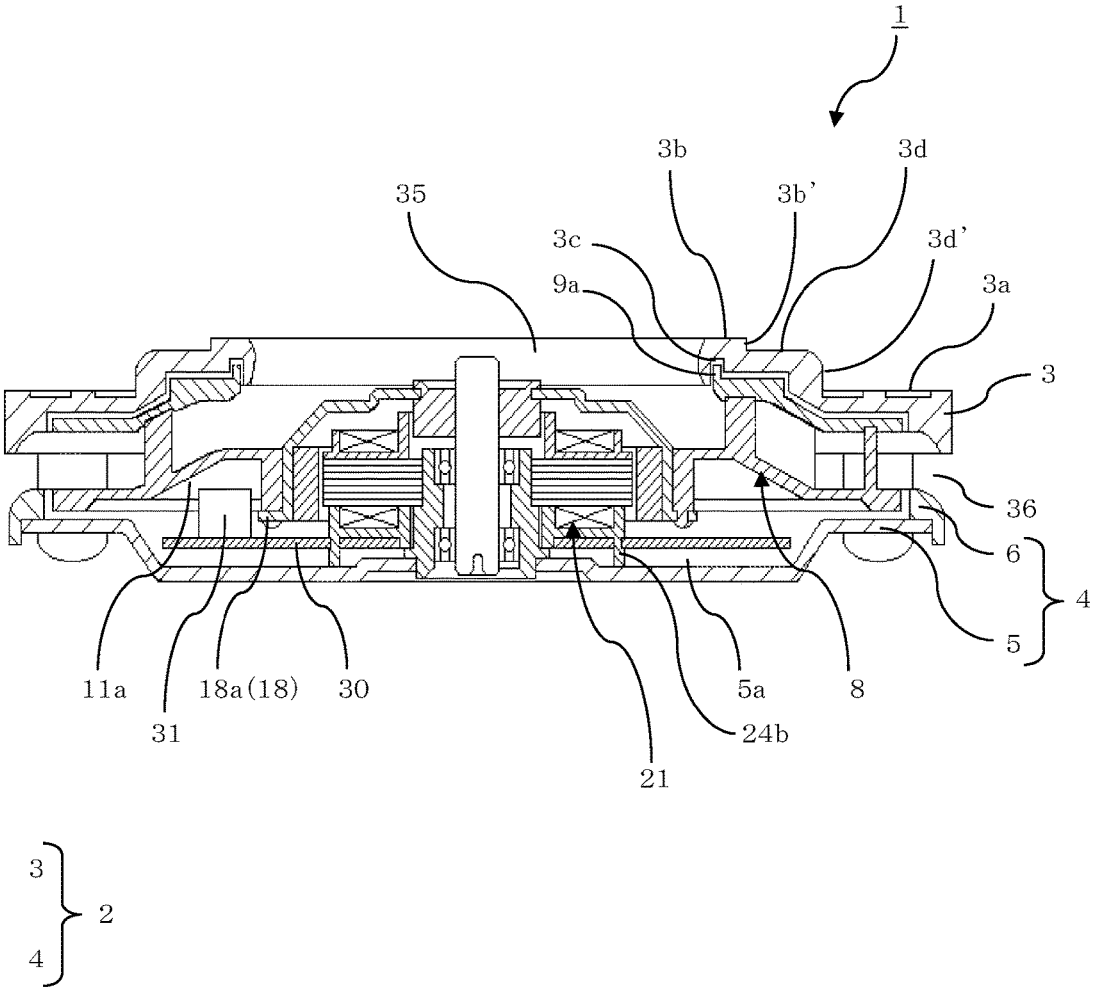
FIG. 5 is a cross-sectional perspective view showing the centrifugal fan in FIG. 4.
Figure 6:
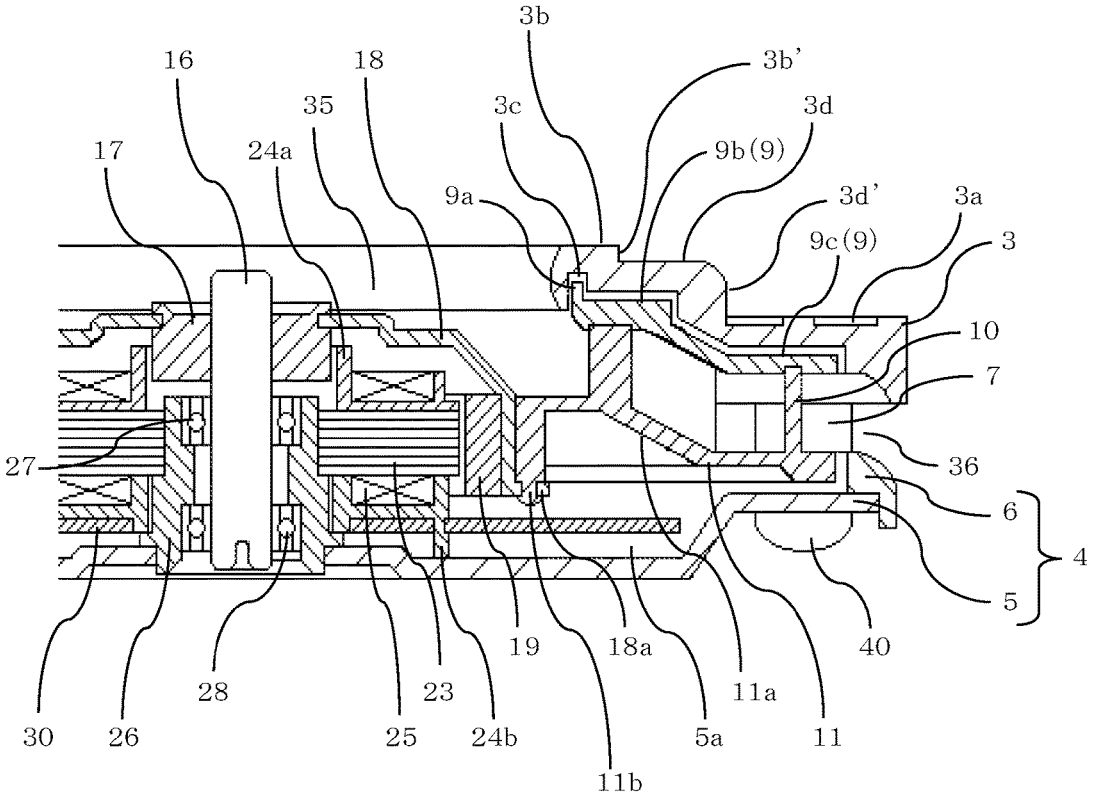
FIG. 6 is a partially enlarged view showing the centrifugal fan in FIG. 5.
Figure 6:
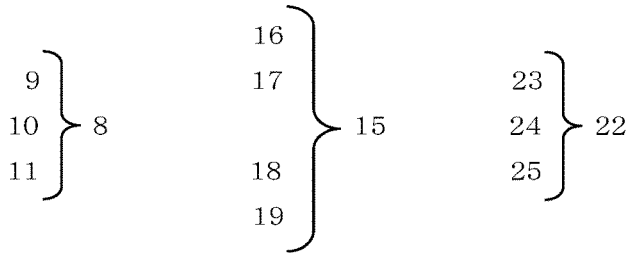
Figure 7:
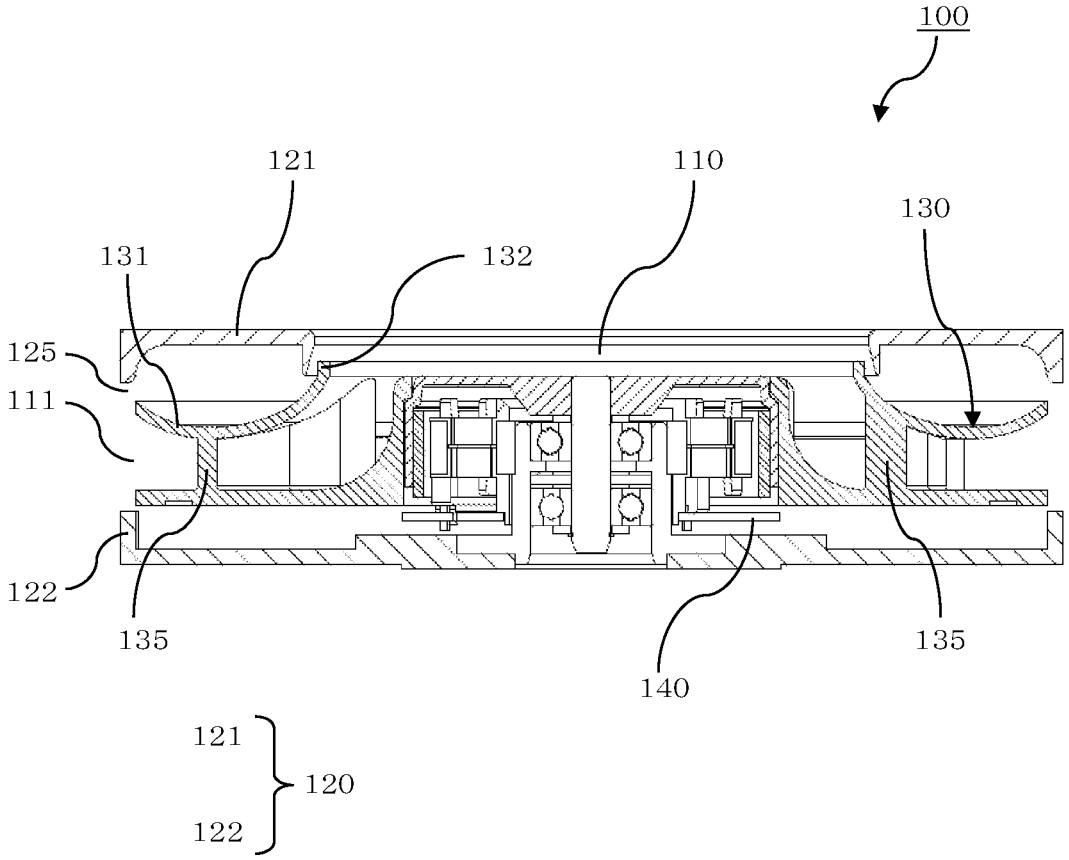
FIG. 7 is a cross-sectional view showing a conventional centrifugal fan.

FIGS. 4 and 5 show a centrifugal fan 1 of a second embodiment of the present invention. A basic structure of the centrifugal fan 1 is a similar structure to that described in Japanese Unexamined Patent Application Publication No. 2012-207600. The centrifugal fan 1 contains a casing 2. The casing 2 is composed of an upper casing 3 and a lower casing 4. An impeller 8 is housed between the upper casing 3 and the lower casing 4. Air is drawn in from a suction port 35 by rotating the impeller 8, the air is passed through blades 10, and is discharged from blowing ports 36 formed on a side surface except for pillars 7 intervened between the upper casing 3 and the lower casing 4 to outside of the casing 2 (outside in a radial direction).

The lower casing 4 is formed by laminating a motor base 5 made of metal (for example, a steel plate) and the base plate 6 made of resin. A bearing holding portion 26 in an approximately cylindrical shape is fixed to the motor base 5. Bearings 27,28 are mounted inside the bearing holding portion 26, and a shaft 16 as a rotating shaft is rotatably supported by the bearings 27,28.

A motor 21, which is an outer rotor type brushless DC motor, is mounted on a bottom surface of a concavity 5*a* formed on the motor base 5. The motor 21 has a lower insulator 24*b*, and the lower insulator 24*b* contacts with the bottom surface of the concavity 5*a*. A circuit board 30 is fixed to the lower insulator 24*b*, and the circuit board 30 is also housed in the concavity 5*a*.

A stator 22, which composes the motor 21, is fixed to the outside of the bearing holding portion 26. The stator 22 contains a stator core 23 in which a desired number of cores made of soft magnetic material in a thin plate shape such as a steel plate, etc., are laminated, an insulator 24 formed by an upper insulator 24*a* and the lower insulator 24*b* mounted from both sides in a shaft direction of the stator core 23 and made of resin, and a coil 25 wound around teeth of the stator core 23 via the insulator 24.

The core in a thin plate shape that forms the stator core 23 has multiple teeth (six teeth in FIG. 4) which extend to the outside in a radial direction from a circular yoke, and the stator core 23 is formed by laminating the cores in a thin plate shape. An opening is formed at the center of the stator core 23, the bearing holding portion 26 engages with the opening.

Side portions 6*a* (see FIG. 4) which extend downwardly are formed at four positions on an outer peripheral edge of the base plate 6, and an outer periphery of four sides of the motor base 5 is contacted with the inside of these side portions 6*a*, so that the motor base 5 and the base plate 6 are positioned.

A rotor 15 contains the shaft 16 rotatably supported by the bearings 27,28, a boss portion 17 mounted on the shaft 16, a rotor yoke 18 in a cup shape fixed to the boss portion 17 by calking, and a circular magnet 19 fixed to the inside of the rotor yoke 18. The rotor 15 which is formed in one body with the below impeller 8, is driven by the motor 21, and rotates against the stator 22.

The impeller 8 is fixed to the rotor 15. The impeller 8 is formed of a circular shroud 9, multiple blades 10, and a main plate 11 in a disc shape, and the blades 10 and the main plate 11 are formed unitarily of resin. The blade 10 is formed in a shaft direction on the main plate 11, has a shape which is bent and tilted backwardly in a rotating direction, and is a backwardly tilted blade in a rotating direction (a so-called turbo type blade). All of the blades 10 have the same shape, and the blades 10 and the circular shroud 9 are joined by for example, welding, and the impeller 8 may be formed by different resin materials using a two-color formation technique. An upper surface of the circular shroud 9 has a first circular step 9*b* and a second circular step 9*c*, and each step 9*b*,9*c* is formed to be an approximately flat surface and an inclined surface is formed between the steps 9*b*,9*c*, and a circular protruded portion 9*a* is formed at an upper edge in a shaft direction of the circular shroud 9. A top of the circular protruded portion 9*a* formed at an upper edge in a shaft direction of the circular shroud 9 is located in a circular concavity (groove) 3*c* formed at a lower surface of the upper casing 3, and it is covered with the upper casing 3.

The main plate 11 of the impeller 8 has an inclined surface 11*a* between an inner peripheral side and an outer peripheral side. That is, the inner peripheral side of the impeller 8 is located at an upper side in a shaft direction, the outer peripheral side of the impeller 8 is located at a lower side in a shaft direction, and the inclined surface 11*a* is located between the inner peripheral side and the outer peripheral side.

The impeller 8 and the rotor 15 are joined by the following manner. A pin 11*b* is formed in one body on a lower surface at an inner peripheral side of the main plate 11, this pin 11*b* is engaged with a pass-through hole formed on the flange 18*a* which extends outwardly in a radial direction from an outer peripheral surface of the rotor yoke 18, and the main plate 11 is fixed to the rotor yoke 18 by heat-calking or infrared-calking a tip of the pin 11*b*. Therefore, the impeller 8 is mounted on the rotor 15.

Multiple concavities 3*a* (relief portions) are formed at an upper side of the upper casing 3. The upper casing 3 and the lower casing 4 are joined by intervening pillars 7 between the upper casing 3 and the lower casing 4 and by fastening the pillars 7 using fastening members such as screws. Specifically, the pillars 7 are formed in one body by the upper casing 3 and resin. Then, the upper casing 3 and the lower casing 4 are joined by screwing tapping screws 40 into lower holes formed on the pillars 7 through pass-through holes 5*d*,6*d* of the lower casing 4. Here, a fastening means is not limited to this process. For example, the casings may be fixed by passing screws (or bolts) through the pass-through holes of the pillars 7 from a side of the lower casing 4, and by fastening nuts from a side of the upper casing 3.

Electronic components 31 such as a controlling IC or parts for controlling and driving the motor 21, etc., are mounted on the circuit board 30. Here, in order to prevent the impeller 8 from contacting the electronic components 31 mounted on the circuit board 30 in a limited space, the inclined surface 11*a* is formed on the main plate 11, and a part of the electronic components 31 is contained at a position of this inclined surface 11*a*. Therefore, the impeller 8 can be prevented from contacting the electronic components 31, and the centrifugal fan can be made thin in a shaft direction.

(2) Features

An opening as the suction port 35 is formed at the center of the upper casing 3, and multiple gap portions (a first gap portion and a second gap portion) are formed on an upper surface of the upper casing 3. The circular protruded portion 3*b* (the first gap portion) which protrudes upwardly in a shaft direction is formed on a periphery of the opening, a second gap portion 3*d* is formed on an outer peripheral portion of the circular protruded portion 3*b*, and the protruded portion 3*b* (the first gap portion) protrudes upwardly from the second gap portion 3*d*. For example, when the centrifugal fan 1 is installed in a housing of a device or apparatus as an object in which the centrifugal fan 1 is installed, the protruded portion 3*b* (the first gap portion) and the second gap portion 3*d* are fitted to a mounting hole or a duct formed on the housing of the device or the apparatus as a socket-and-spigot structure. That is, an outer peripheral side surface 3*b*' of the protruded portion 3*b* (the first gap portion) and an outer peripheral side surface 3*d*' of the second gap portion 3*d* are contacted and fitted with an inner periphery of the mounting hole of the device or the apparatus as an object in which the centrifugal fan 1 is installed. According to this structure, the centrifugal fan 1 can be easily positioned in mounting on the device or the apparatus and accuracy of the positioning can be improved. As a result, in connection with size of the opening formed on the housing also, it is not necessary to consider variation in mounting the centrifugal fan 1.

The circular concavity (groove) 3*c* is formed on a lower surface of the circular protruded portion 3*b* of the upper casing 3, and a top of the circular protruded portion 9*a* formed at an upper edge in a shaft direction of the circular shroud 9 is located in the circular concavity (groove) 3*c* formed on a lower surface of the upper casing 3, so that the circular protruded portion 9*a* is covered with the upper casing 3. Then, a labyrinth seal structure is formed between a side surface of the protruded portion 9*a* of the circular shroud 9 and the upper casing 3. According to this labyrinth structure, a part of the air blown out from an outer periphery of the impeller can be prevented from flowing in an opposite direction to the suction port 35.

In addition, the first circular step 9*b* formed on the upper surface of the circular shroud 9 is approximately flat. Therefore, the second gap portion 3*d* of the upper casing 3 is formed at a position opposing the first circular step 9*b*. A thick portion of the first circular step 9*b* can be used as a position for adjusting balance of the impeller 8. Specifically, the balance can be adjusted by forming a concavity 9*d* at this thick portion of the step 9*b*, and by mounting a weight to the formed concavity 9*d* as a positive balance adjustment or removing a part of this thick portion of the step 9*b* as a negative balance adjustment.

In the centrifugal fan having a conventional structure described in Japanese Unexamined Patent Application Publication No. 2012-207600, it is necessary that the centrifugal fan be made thin by decreasing the total height thereof, when a mounting space for the centrifugal fan is small. In this case, since it is also necessary to use a thin type impeller, a cross-sectional area of a passage at an air suction side of the impeller is decreased, and ventilation resistance is increased, and as a result, noise is increased. In contrast, in the centrifugal fan 1 according to the present invention, the protruded portion 3*b* (the first gap portion) and the second gap portion 3*d* (or only the second gap portion 3*d*) are engaged with the inside of the mounting hole or the duct formed on a housing of the device or the apparatus (an object in which the centrifugal fan is installed) as a socket-and-spigot structure. According to this structure, a cross-sectional area of a passage at an air suction side of the impeller 8 cannot be decreased; that is, the cross-sectional area of a passage at an air suction side of the impeller 8 can be increased more than that of the impeller of the conventional centrifugal fan described in Japanese Unexamined Patent Application Publication No. 2012-207600, even if a total height of the centrifugal fan is the same as that of the conventional centrifugal fan described in Japanese Unexamined Patent Application Publication No. 2012-207600. As a result of this, the ventilation resistance can be reduced, air volume characteristics can be improved, the noise can be decreased, and the centrifugal fan can be made thin.

In particular, in the present embodiment, the top 9*a* of the circular protruded portion formed at an upper edge of the circular shroud 9 is overlapped with the outer peripheral side surface 3*d*' of the second gap portion 3*d*, when it is viewed from a direction perpendicular to the rotating shaft (the shaft 16). That is, labyrinth seal structure formed between the upper casing 3 and the impeller 8 is overlapped with the outer peripheral side surface 3*d*' of the second gap portion 3*d*. In this structure, the labyrinth seal structure formed at an upper portion of the centrifugal fan 1, that is, the labyrinth seal structure formed between the upper casing 3 and the impeller 8, is obtained in a structure of an object to be installed, and therefore, the centrifugal fan 1 can be made thin and the cross-sectional area of a passage at an air suction side of the impeller 8 can be maintained.

Furthermore, in the centrifugal fan 1 of the present embodiment, multiple gap portions (the first gap portion and the second gap portion) are formed on the upper surface of the upper casing 3, and the protruded portion 3*b* (the first gap portion) and the second gap portion 3*d* (or only the second gap portion 3*d*) are engaged with the inside of the mounting hole or the duct formed on the housing of the device or the apparatus as a socket-and-spigot structure. However, the third gap portion (or multiple gap portions) is formed outwardly in a shaft direction of the second gap portion, and the first gap portion, the second gap portion and the third gap portion (or only the third gap portion) may be engaged with the inside of a mounting hole or an air duct formed on a housing of a device or apparatus, as a socket-and-spigot structure. The gap portions may be placed at three positions or more.

EXPLANATION OF REFERENCE SYMBOLS

1 . . . centrifugal fan, 2 . . . casing, 3 . . . upper casing, 3*a* . . . concavity, 3*b* . . . circular protruded portion (first gap portion), 3*c* . . . circular concavity, 3*d* . . . second gap portion, 4 . . . lower casing, 5 . . . motor base, 5*a* . . . concavity, 5*d* . . . pass-through hole, 6 . . . base plate, 6*a* . . . side portion, 6*d* . . . pass-through hole, 7 . . . pillar, 8 . . . impeller, 9 . . . shroud, 9*a* . . . protruding portion, 10 . . . blade, 11 . . . main plate, 11*a* . . . inclined surface, 11*b* . . . pin, 15 . . . rotor, 16 . . . shaft, 17 . . . boss portion, 18 . . . rotor yoke, 18*a* . . . flange, 19 . . . magnet, 20 . . . flange, 21 . . . motor, 22 . . . stator, 23 . . . stator core, 24 . . . insulator, 24*a* . . . upper insulator, 24*b* . . . lower insulator, 25 . . . coil, 26 . . . bearing holding portion, 27 . . . bearing, 28 . . . bearing, 30 . . . circuit board, 31 . . . electronic component, 35 . . . suction port, 36 . . . blowing port.

The invention claimed is:

1. A centrifugal fan, wherein an impeller comprising a shroud is housed inside a casing that is formed by an upper casing and a lower casing, air drawn in from a suction port formed on the casing by rotating the impeller is discharged from the casing to the outside of a blowing port that is formed over an entire side surface between the upper casing and the lower casing except for pillars intervened therebetween, and multiple gap portions for engaging with an object in which the centrifugal fan is installed and multiple concavities are formed on an upper surface of the upper casing, the multiple gap portions comprise a first gap portion composed by a circular protruded portion which protrudes upwardly in a shaft direction and is formed on a peripheral edge of the suction port, and a second gap portion formed outside in a radial direction of the circular protruded portion, and the circular protruded portion protrudes upwardly from the second gap portion, wherein the multiple concavities are located radially outside the second gap portion, an upper surface of the shroud has a first step and a second step and the second gap portion of the upper casing faces the first step of the shroud, the first step of the shroud is located closer to the suction port side in the shaft direction than the portion where the multiple concavities are provided.

2. The centrifugal fan according to claim 1, wherein a circular groove is formed on a lower surface of the circular protruded portion, and the circular protruded portion is formed at an upper edge of the shroud, and a top of the circular protruded portion is located in the circular groove.

3. The centrifugal fan according to claim 2, wherein the top of the circular protruded portion formed at an upper edge of the shroud is overlapped with a peripheral side surface of the second gap portion, when it is viewed from a perpendicular direction to a rotating shaft.

4. The centrifugal fan according to claim 1, wherein a labyrinth seal structure formed between the casing and the impeller is overlapped with a peripheral side surface of the second gap portion, when it is viewed from a perpendicular direction to a rotating shaft.

5. The centrifugal fan according to claim 1, wherein the first step of the shroud has a thick portion for adjusting balance of the impeller.

6. The centrifugal fan according to claim 5, wherein the multiple concavities are formed in the thick portion, and a weight is mounted to the concavities as a positive balance adjustment or the multiple concavities are utilised as a negative balance adjustment.

7. The centrifugal fan according to claim 1, wherein radial ribs and circular ribs that connect the radial ribs are formed such that an individual concavity is formed in the radial ribs and the circular ribs.

8. The centrifugal fan according to claim 1, wherein the first gap and the second gap are flat surfaces substantially perpendicular to the shaft direction.

* * * * *